United States Patent [19]

Comtois et al.

[11] Patent Number: 4,668,926

[45] Date of Patent: May 26, 1987

[54] PROTECTIVE SWITCH

[75] Inventors: Patrick Comtois, Chevigny Saint Sauveur; Raymond Ingrain, Quetigny; Luc Moreau, Dijon; Serge Paggi, Ruffey Les Echirey, all of France

[73] Assignee: La Telemecanique Electrique, France

[21] Appl. No.: 828,485

[22] Filed: Feb. 12, 1986

[30] Foreign Application Priority Data

Feb. 14, 1985 [FR] France ..... 85 02119

[51] Int. Cl.[4] ..... H01H 75/00

[52] U.S. Cl. ..... 335/21; 335/191

[58] Field of Search ..... 335/23, 35, 38, 16, 335/15, 21, 22, 190, 191, 192

[56] References Cited

U.S. PATENT DOCUMENTS 2,843,699 7/1958 Leatherberry ..... 335/22

3,079,479 2/1963 Schwartz et al. ..... 335/38

4,550,300 10/1985 Jencks et al. ..... 335/22 X

*Primary Examiner*—Patrick R. Salce

*Assistant Examiner*—Anita M. Ault

*Attorney, Agent, or Firm*—William A. Drucker

[57] ABSTRACT

The apparatus of the invention comprises a case housing a fixed contact and a mobile contact carried by a pivoting lever, with resilient return to the closure position, a rocking lever adapted for acting on the pivoting lever in the opening direction in response to an electric fault and a manual control member connected to the pivoting lever. A single spring exerts on the pivoting lever a first torque in the closure direction and on a drive piece blockable by the rocking lever a force adapted to generate on the lever a second torque antagonistic to and greater than the first one. With the manual control member a third torque antagonistic to and greater than the first one is exerted on the pivoting lever.

11 Claims, 17 Drawing Figures

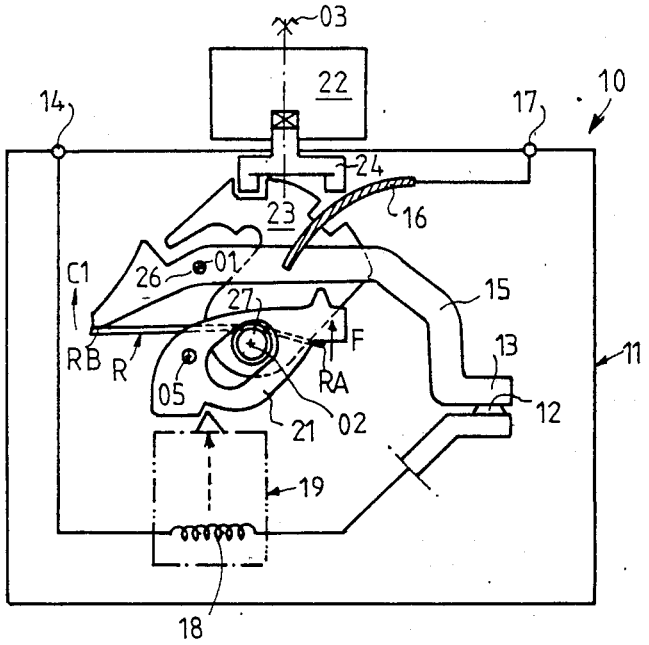
FIG. 1
FIG. 2
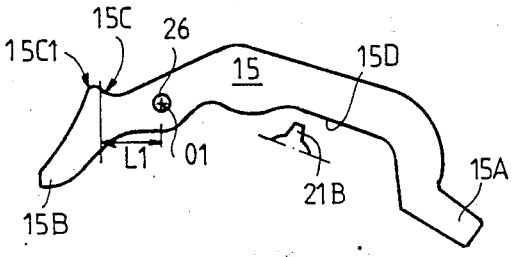
FIG. 3
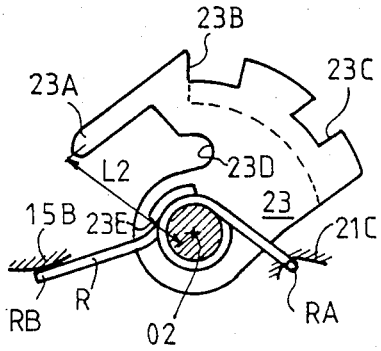
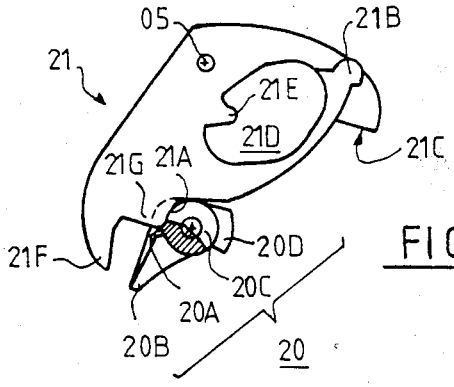
FIG. 4

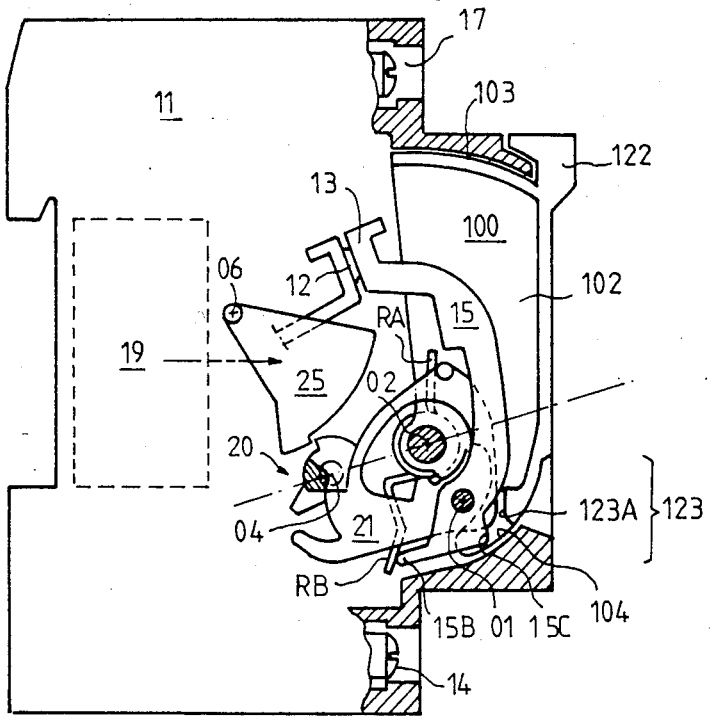
FIG.10
FIG.15
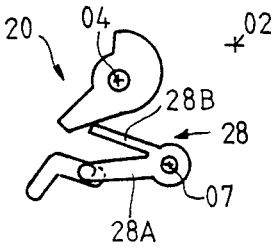
FIG.16
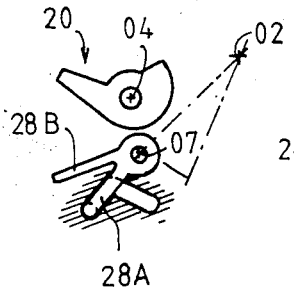
FIG.17
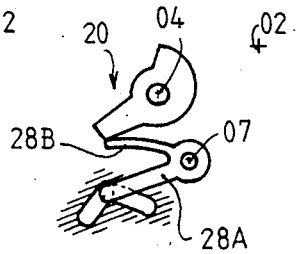

PROTECTIVE SWITCH

BACKGROUND OF THE INVENTION

1. Field of the Invention

The present invention relates to an electric single pole or multipole protective switching apparatus providing automatic tripping on a fault and manual opening and resetting control.

2. Description of the Prior Art

Protective switches are already known comprising a case which houses at least two separable contacts, one of the contents being carried by a lever capable of pivoting about a first axis in response to an electric fault or manual control. The contact carrying lever pivots:

either from a closed position to an open position of the contacts in response to the movement of an engagement element urged by an automatic tripping member;

or from the closed position to an open position of the contacts in response to the actuation of a manual or voluntary control member, this member cooperating with a control piece inserted between said member and the contact carrying arm.

Such a switch is known from the French Pat. No. 2 540 667.

The aim of the invention is more especially to simplify the arrangement of a protective switch of the above defined type, which allows, by the manual control of the switch, to obtain a breaking action causing a large amplitude of opening of the mobile contact with respect to the fixed contact.

SUMMARY OF THE INVENTION

The invention concerns a protective switch providing opening following automatic tripping on a fault or a manual command and comprising:

a case housing at least one fixed contact and one mobile contact, a lever carrying the mobile contact, mounted for pivoting about a first axis and urged resiliently in the closure direction of the contacts, a tripping member actuating a hook in response to an electric fault for causing the lever to pivot in the direction of opening of the contacts, a manual control member connected to the contact carrying lever through a drive element.

In accordance with the invention, a single spring exerts, on the one hand, on the contact carrying lever a first torque ensuring the pressure of the contacts at least at closure and, on the other hand, on an intermediate drive piece blockable by the tripping hook a force transmissible to the contact carrying lever; this force is only transmitted to the contact holding lever should tripping on a fault occur following retraction of the hook so as to produce on the lever a second torque antagonistic to and greater than the first torque; the intermediate drive piece is associated with a bearing surface provided on the contact carrying lever at a position such that operation of the manual control member produces on the lever a third torque antagonistic to and greater than the first torque.

BRIEF DESCRIPTION OF THE DRAWINGS

Embodiments of the invention will be described hereafter by way of non limitative examples with reference to the accompanying drawings in which:

FIG. 1 shows schematically in elevation a protective switch in accordance with the invention;

FIGS. 2, 3 and 4 are elevational views of different parts of the switch of FIG. 1;

FIG. 10 shows schematically in elevation a variant of the protection switch;

FIGS. 15, 16, 17 show schematically a variant.

DESCRIPTION OF THE PREFERRED EMBODIMENTS

Figure 5:
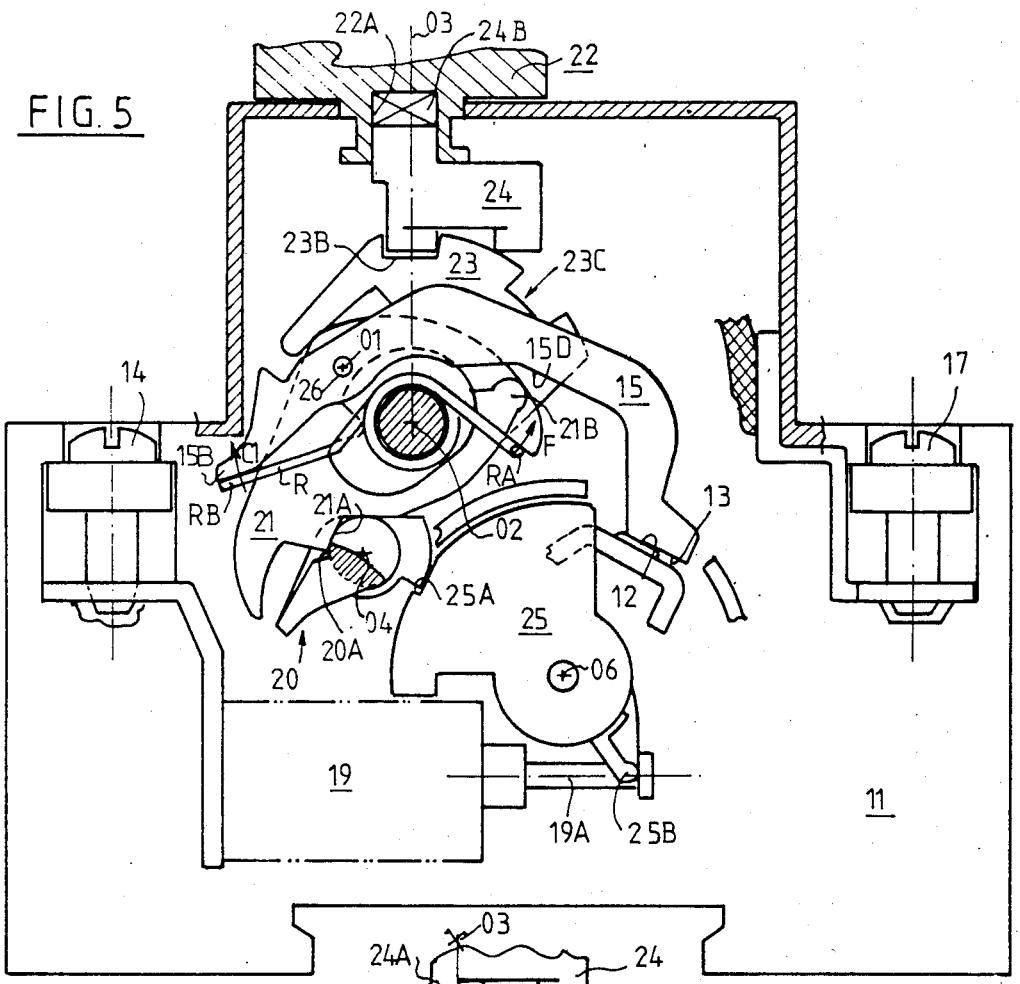
FIGS. 5 to 8 show one embodiment of the switch of FIG. 1, respectively in the closed, breaking on a fault, manual opening and reset positions.

The switch of FIG. 1 is designated by the general reference 10 and comprises a case 11 in which are housed at least one fixed contact 12 and a mobile contact 13; the fixed contact 12 is connected to a terminal 14 via a connecting piece not shown, whereas the mobile contact 13 is disposed on a contact carrying lever 15 connected electrically by a braided wire 16 and a fixed connecting piece to a terminal 17. The electric connection between the fixed contact 12 and terminal 14 comprises a coil 18 belonging to an electromagnet which forms the means for automatic tripping on a fault 19 of the apparatus considered.

The armature or plunger 19*a* (shown in FIG. 5) of the electromagnet 19 acts on a rotary engagement piece or hook 20 which cooperates with a rotary drive piece or "beak" 21 itself capable of acting on the contact carrying lever 15, which lever is mounted for pivoting on a pin 26 with axis 01. A hairpin spring R is wound about a pin 27 with axis 02 and has a first leg applied directly on one of the arms of lever 15 and a second opposite leg urging piece 21 in a way which will be described further on.

A manual control button 22 situated outside case 11 cooperates with a piece 23 for controlling the contact carrying lever 15; the button is mounted for pivoting about an axis 03 perpendicular to the axis 01 whereas the control piece is mounted so as to rotate about an axis parallel to 01, for example on the pin 27 with axis 02 for saving space. An appropriate mechanical meshing and/or cam connection transforms the rotary movement of button 22 into a correlative rotary movement of the control piece 23.

The contact carrying lever 15 (FIG. 2) carries the mobile contact 13 at the end 15A of a first arm; it is urged at the end 15B of a second arm, opposite the end 15A with respect to the axis 01, by the end RB of the first leg of the hair pin spring R whose central part is wound about a pin 27 with axis 02. A shoulder or similar bearing surface 15C is provided on the part of the lever 15 situated between axis 01 and the end 15B for cooperating with a surface driving the control piece 23.

Shoulder 15C is provided at a small distance from the axis 01 so that a relatively reduced rotation of button 22 causes a considerable angular movement of the contact carrying lever and so opening with breaking characteristic. Visibility of the breaking is ensured by the fact that case 11 is transparent, either entirely, or only at the level of the zone of the mobile contact 13.

The control piece 23 (FIG. 3) comprises as driving surface associated with shoulder 15C a finger 23A; it further comprises a cam or imprint with two notches 23B, 23C intended to cooperate with a piece 24 comprising a cam or tenons 24A, 24C (FIGS. 6 to 8); it finally comprises, as element taking part in the resetting phase, a recess 23D which comes into abutment against pin 26 at the end of resetting and a shoulder 23E which determines the disengagement of the drive piece 21 from hook 20 during resetting. Piece 24 is able to rotate about axis 03 in response to the pivoting of button 22 and for this purpose it has a square portion 24B ccoperating with a recess 22A of the button 22.

The drive piece or beak 21 (FIG. 4) has an engagement face 21A intended to cooperate with an engagement element 20A of the hook 20. In the present embodiment, the hook 20 is a shaft with axis 04 mounted for pivoting in the case about said axis. Piece 21 further has a projection or other bearing element 21B able to be applied on a zone 15D of thelever situated between axis 01 and contact 13 so that an anticlockwise pivoting movement of piece 21 causes a rotation in the same direction, so anticlockwise, of arm 15. A bearing point 21C is provided at the right hand of piece 21 in the vicinity of the bearing surface 21B for receiving the end RA of the second leg of the hairpin spring R opposite the first leg with end RB.

The drive piece 21 further comprises a central oblong recess 21D shaped in an appropriate way so as to allow fitting of piece 21 on pin 27 and a certain free movement of piece 21 with respect to said pin during its rotation about 05. The contour of the recess 21D has a reset heel 21E or other projection the purpose of which will be explained further on. For reducing the space requirement of the switch the axes 01 and 05 are preferably merged as will be seen from FIGS. 5 to 8.

Hook 20 (FIG. 4) is mounted so as to pivot in an anticlockwise direction about axis 04 during tripping on a fault, against the force of a return spring not shown. Hook 20 is a shaft comprising structures, namely the hooking or engagement element 20A already described and a pointed projection 20B directed substantially downwards (FIGS. 4 and 5–8) and against which a confirmation face or appendix 21F of piece 21 is applied at the end of tripping on a fault. In hook 20 there is provided a clearance 20C which allows a wedge 21G of the drive piece 21 to move rightwards after the hooking face 21A thereof has been released by the hook, and a catch or other upstream engagement element 20D.

FIGS. 5 to 8 show the switch apparatus of FIG. 1 in the respective positions of:

closure of the contacts, breaking following automatic tripping on a fault, isolating following manually controlled opening, resetting following tripping or manual opening.

Figure 6:
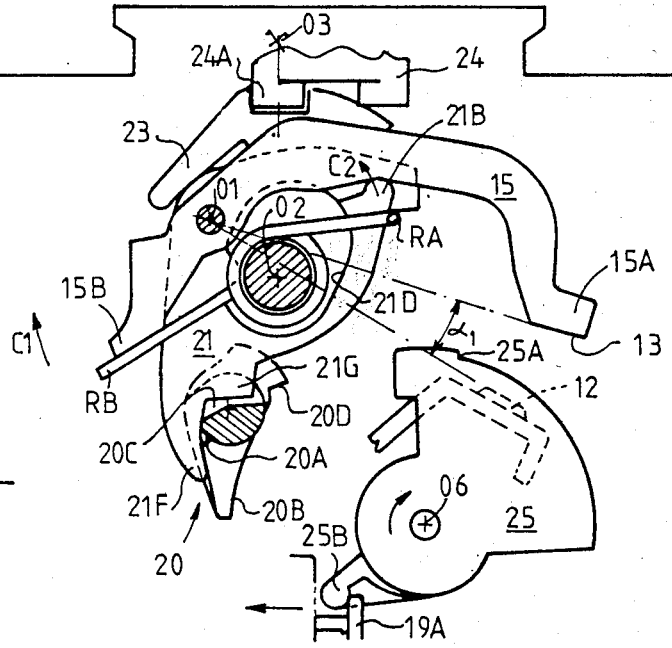
Figure 7:
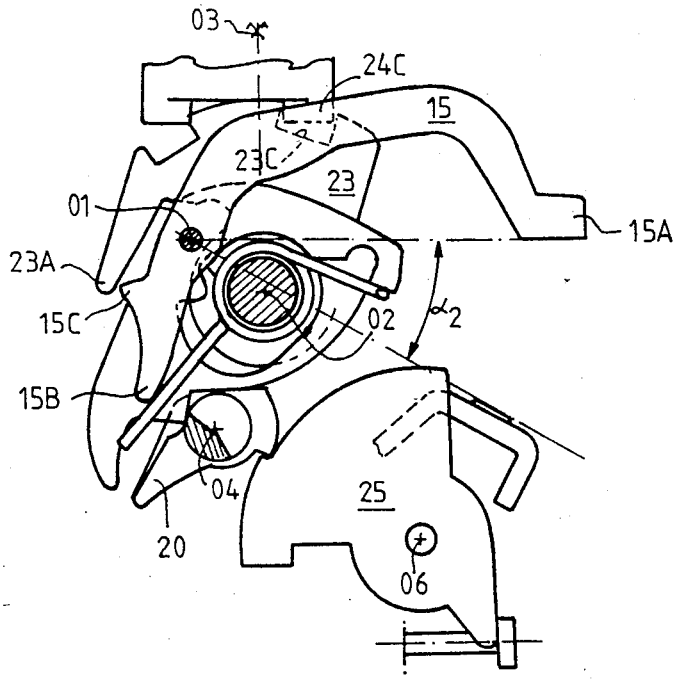

The axes 01, 02 are fixed with respect to case 11 and the angular movement $\alpha 1$ of the contact carrying lever 15 about axis 01 in response to the movement of the hook in the case of tripping on a fault (FIG. 6) is less than the angular movement $\alpha 2$ of lever 15 about axis 01 in response in placing button 22 in the "stop" position by rotation about the axis 03 (FIG. 7). The distance L1 (FIG. 2) from the shoulder 15C of lever 15 to the axis 01 is chosen very small and in any case less than the distance L2 from the drive finger 23A of the control piece 23 to the axis 02 so as to provide the large angular movement desired $\alpha 2$ with relatively small angular movement of button 22 and so as to produce on lever 15 a third torque C3 antagonistic to and greater than the first torque C1.

Furthermore, the same spring R ensures at closure the desired pressure of the mobile contact 13 on the fixed contact 12 and during tripping on a fault a sudden angular movement of lever 15 because the spring R exerts:

by its leg RB on the contact carrying lever 15 a first torque C1 for ensuring the pressure of the contacts by its leg RA on piece 21 a force F transmissible during tripping on a fault to lever 15 in the form of a second torque C2, antagonistic to and greater than the torque C1, so as to produce rapid opening of the contacts.

In the closed position illustrated in FIG. 5, the mobile contact 13 is applied against the fixed contact 12 under the effect of the clockwise torque C1 exerted by leg RB of spring R on the end 15B of the contact carrying lever 15. It should be noted that the force F communicated in an anticlockwise direction to the drive piece 21 by the other leg RA of spring R is not transmitted to lever 15 because the bearing element 21B of piece 21 remains held apart from zone 15D of lever 15 following abutment of face 21A of piece 21 on the engagement element 20A of hook 20.

The rotary hook 20 with axis 04 is urged by its return spring, not shown, so as to be applied by means of a catch 20D against a stop which is movable or retractable during tripping on a fault. This stop is here formed by a catch 25A provided on a rotary isolating screen 25 with axis 06 in the form of a cap insertable between the contacts on opening of the mobile contact 13 (see FIG. 6). The stop may of course be formed by any appropriate element connected to or controlled by the armature of the magnetic tripping means.

Button 22 rotatable about axis 03 cooperates through the connecting piece 24 comprising tenons 24A, 24B with the cam or imprint 23B, 23C of the control piece 23. Finger 23A is not applied in the closed position against shoulder 15C.

The apparatus arrives at the tripping on a fault position shown in FIG. 6 when an overcurrent or short circuit current flows through the coil 18 of the tripping electromagnet 19. The plunger 19A of the electromagnet 19 is then attracted and moves leftwards while causing the screen 25 to rotate in a clockwise direction by engagement with a bearing surface 25B provided under the screen. The catch 25A of the screen then pushes back the ear 20D of the hook 20 which pivots slightly in an anticlockwise direction; thus, the engagement element 20A frees the face 21A of piece 21 urged in an anticlockwise direction by the leg RA of spring R. The wedge 21G may then engage in the clearance 20C of hook 20 and the appendix 21F of piece 21 is applied against the tip 20B of hook 20; piece 21 thus confirms tripping and comes into the abutment position shown in FIG. 6, this abutment position determining the stop positions of spring R and of the contact carrying lever 15, this latter having pivoted through an angle $\alpha 1$.

During the tripping phase which has just been described, spring R continues to exert the torque C1 on lever 15. However, the projection 21B of the drive piece 21 bears on the zone 15D of lever 15 so as to transmit to the lever an anticlockwise torque C2, so antagonistic to and greater than the torque C1.

It will be understood that the bearing zones of legs RB and RA of the spring on lever 15 and respectively on piece 21, as well as the bearing zone of spur 21B on zone 15D of the lever, are determined so as to obtain the desired resultant opening torque C2-C1 on the lever.

The position of the control piece 23 is not modified during the tripping on a fault phase which has just been described.

Figure 9:
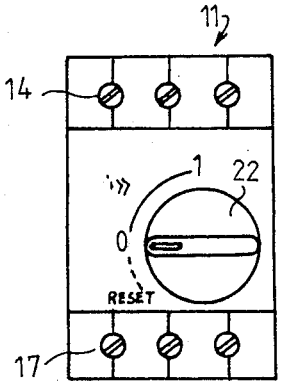
FIG. 9 is a front view of a switch in a three pole version.

The switch is placed in the isolating position (FIG. 7) when the operator rotates button 22 about axis 03 so as to bring it from the on position (shown as "1" in FIG. 9) to the tripping position (shown as "0" in FIG. 9). Rotation of button 22 is then through 90° but may of course take place over a different angle.

During this manual opening, the drive piece 21 and hook 20 do not change position ; the control piece 23 is on the other hand driven by button 22 so as to produce the anticlockwise pivoting movement through an angle $\alpha 2$ of the contact carrying lever 15.

Rotation of button 22 from "1" to "0" determines the rotation about axis 03 of the connecting piece 24 whose tenon 24C engages in the notch 23C of the imprint of piece 23. The result is an anticlockwise pivoting movement of the control piece 23 about the pin with axis 02 and engagement of the thrust finger 23A of said piece with the shoulder 15C of the contact carrying lever 15. Then, the movement of finger 23A causes lever 15 to pivot in an anticlockwise direction as far as the position shown in FIG. 7. The end arm 15B of lever 15 forces the end RB of spring R to come into the low position shown in FIG. 7, whereas the other end RA of the spring remains braced against piece 21. A small angular movement of button 22 and piece 23 causes, because of the small distance L1 between shoulder 15C and axis 01, a large angular movement $\alpha 2$ of lever 15.

It will be noted that at the end of manual opening of contact 13, the driver finger 23A rides over the top 15C1 of shoulder 15C so as to be able to come down beyond the shoulder during a subsequent resetting phase.

Figure 8:
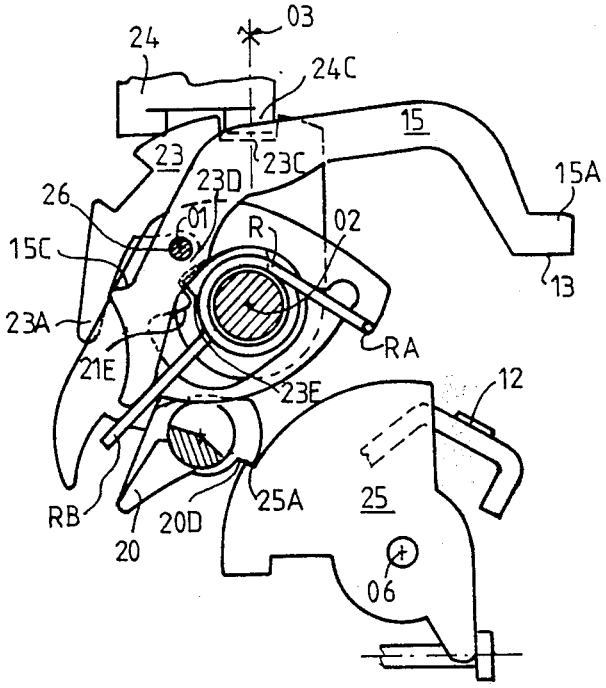

Resetting (FIG. 8) is effected by rotating the button 22 in an anticlockwise direction beyond the position "0" of FIG. 9 to the position marked "reset" in the same Figure. Referring to FIG. 8, it can be seen that the tenon 24C of the connecting piece 24 connected to button 22 continues to urge the imprint 23C; thus, the control piece 23 describes about 02 an anticlockwise movement permitted by the riding of finger 23A over shoulder 15C, until the recess 23D of piece 23 abuts against the pin 26 with axis 01. During this movement, shoulder 23E of piece 23 is applied against the heel 21E which projects into the recess 21D of the drive piece 21.

Piece 21 is then forced to pivot slightly in a clockwise direction about the axis 01 so that its wedge 21G frees the hook 20 which, under the effect of the return spring not shown, comes back to the set position shown in FIGS. 5, 7 and 8 in which it is in engagement with the rotary screen which has itself come back to its position freeing the contacts.

When button 22 is again placed in its position "1", via the connecting piece 24 it returns the control piece 23 to the position shown in FIG. 5, whereas the drive piece 21 may pivot in an anticlockwise direction so as to be applied by its face 21A against the engagement element 20A of hook 20.

In the embodiment of FIG. 10, the element whose construction and functions are the same as in the preceding embodiment bear the same references.

The switch of FIG. 10 differs from that of FIGS. 5 to 9 by the fact that the button 22, connecting piece 24 and the control piece 23 are replaced by a manual rocking lever 100 comprising a gripping element 122 and forming the isolating and resetting control piece 123; the rocking lever 100 is mounted for pivoting about an axis merging with the axis 02. The pivoting axis of the rocking lever could of course be parallel to axis 02 and separate therefrom. The switch of FIG. 10 further aims at obtaining wide opening of the mobile contact 13 in the case of a manual control exerted on the gripping member 122 of the rocking lever, such opening being comparable to disconnection whose visibility is provided for example by the transparency of the rocking lever and/or by specific optical elements associated with the rocking lever and with the contact carrying lever 15.

The rocking lever 100 has, besides the gripping element 122, at least one face 102 parallel to the plane of the Figure, two annular guide surfaces 103, 104 centered on the axis 02, oppositely located with respect to this axis and unequally spaced therefrom, as well as a control part 123. This part 123 comprises a bearing element 123A provided close to the surface 104 and/or associated with this surface for cooperating with the shoulder 15C of lever 15.

Figure 11:
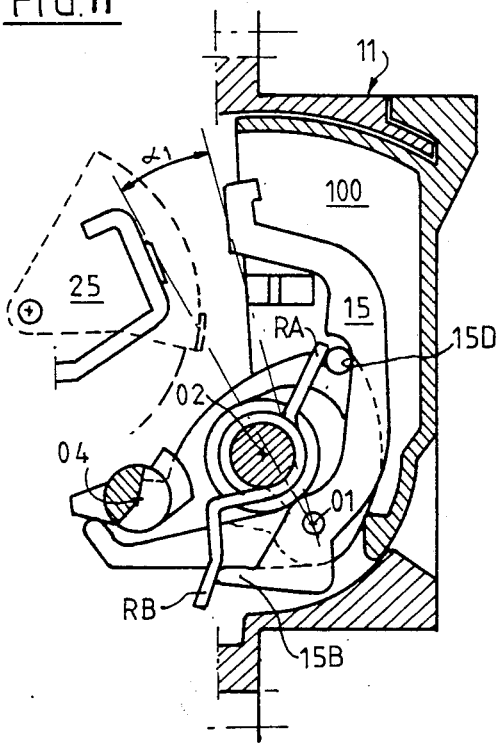
FIGS. 11 and 12 show a part of the switch of FIG. 8 in the respective tripping on a fault and manual opening or isolating positions.

In accordance with the invention, spring R is permanently applied by its leg RB against the end 15B of lever 15 and therefore exerts thereon a torque C1 for ensuring the closing pressure of the contacts; by its leg RA it permanently applies a force to the drive piece 21, this force being transmitted or not to lever 15 depending on whether hook 20 releases or locks piece 21; when it is transmitted, said force results in a torque C2 exerted on a lever 15 which is antagonistic to torque C1 and in absolute value greater than this torque, producing opening of the mobile contact of an angular amplitude $\alpha 1$ (FIG. 11).

Tripping on a fault of the switch of FIG. 10 is shown in FIG. 11, but will not be described for it is similar to that of the switch of FIGS. 1 to 9.

Manual opening of the switch is comparable to disconnection and will be described with reference to FIG. 12. The operator rotates the rocking lever 122 in a clockwise direction so as to bring it in the position shown in FIG. 12. The drive element 123A of the rocking lever is applied to the shoulder 15C of the contact carrying lever 15, which causes a clockwise rotation of lever 15 about the axis 01. The end 15B of the lever rides over the leg RB of spring R while coming nearer to the axis 02 which causes, during pivoting, a reduction of the contact pressure torque C1 exerted by spring R on the lever. The other leg RA of the spring remains applied to the spur or bearing element 21B, but the drive piece 21 remains locked by the hook 20. The manual opening force may however remain relatively small because of the small distance separating shoulder 15C from axis 01, this distance being less than that of the end 15B from the same axis. Lever 15 pivots through an angle $\alpha 2$ very much greater than $\alpha 1$ and it is substantially housed in the rocking lever 100 at the end of opening; the visibility of the disconnection obtained may be provided by any known means, for example by the fact that the rocking lever is made from transparent material, and the contact carrying lever 15 and the facing surfaces of the rocking lever and/or of the case comprise magnifying elements and/or elements of different colors so that movement of the lever results in an optical modification, for example a movement of focus or of an optically reflecting surface.

Figure 12:
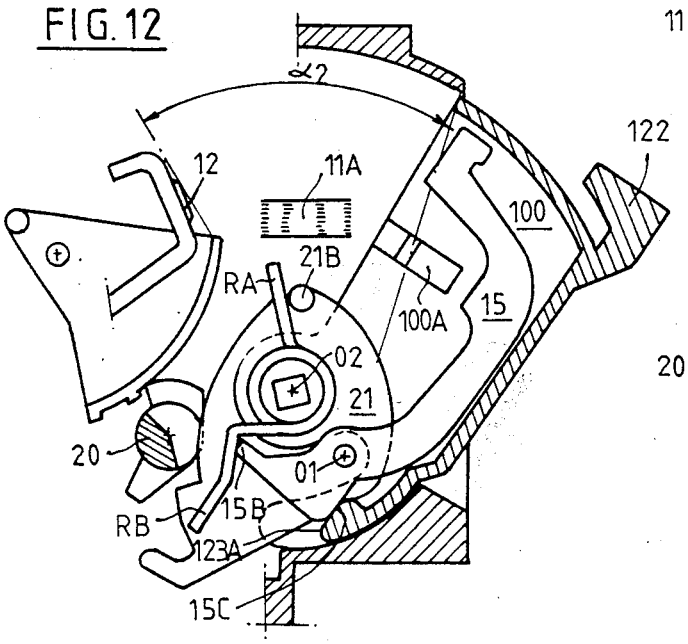
Figure 13:
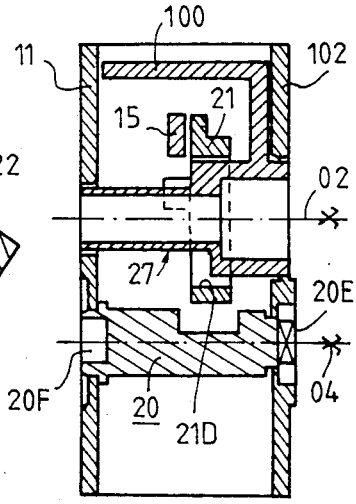
FIG. 13 is a sectional view through line XI—XI of FIG. 10.

In the embodiment shown in FIGS. 10 to 13, resilient retainer means 11A, 100A shown in FIG. 12 are provided, disposed respectively in the case 11 and the rocking lever 10 and one at least of which is resilient in the direction perpendicular to the plane of the Figure and is adapted, on the one hand, to let the contact carrying lever 15 pivot sharply on opening of the contacts and, on the other, to engage said lever on closure so as to retain it at the beginning of the closure operation and to release it suddenly at the end of the closure operation.

Figure 14:
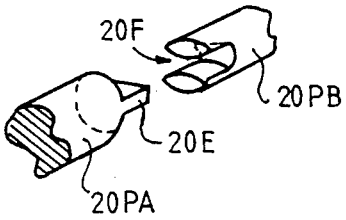
FIG. 14 shows in an exploded perspective view the coupling of the hooks of two adjacent poles.

In the two embodiments described, the pivoting hook 20 may be advantageously housed in bearings forming part of the case while having, on its two end faces perpendicular to axis 04, a tenon, for example a flat portion 20E and respectively a notch 20F, for example of a bell mouth shape (FIG. 14). The tenon may thus be coupled with play to the notch of the hook of an adjacent pole. Thus, tripping on a fault of one pole causes tripping of the other poles of the switch when this latter is multipole, since rotation of the flat 20E of hook 20PA of pole A takes place with a slight lost travel allowing opening of the contacts of pole A, then causes rotation of the hook 20PB of the pole B. It goes without saying that any other mechanical coupling means producing a slight delay of transmission from pole to pole could be integrated in the switch.

In a multipole version of the switch, manual control of the levers or contact bridges 15 of the different poles is provided from button 22 on as many control pieces 23 as there are poles, the pieces 23 being coupled together.

In a variant usable not only for the embodiment shown in FIGS. 1 to 9 but also in that of FIGS. 10 to 13, the manual control acts on hook 20 so as to obtain sudden opening of the contacts. The control piece 23, 123 comprises in addition to the drive element 23A, 123A a transmission piece 28 articulated to said control piece by means of a pin with axis 07. Piece 28 has the shape of a fork one prong 28A of which is guided in a curved guide 29 formed in a face of the case and the other prong 28A of which is resilient and allows the hook 20 to be driven during manual opening (FIG. 15), while resiliently riding over the hook during the resetting (FIG. 17).

It goes without saying that modifications may be made to the embodiments described without departing from the scope and spirit of the invention.

What is claimed is:

1. In an electric protective switching apparatus providing automatic tripping on a fault and manual opening, comprising:

a case housing at least one fixed contact and a mobile contact, a lever carrying the mobile contact, mounted for pivoting about a first axis and urged resiliently in the direction of closure of the contents, a tripping member actuating, in response to an electric fault, a hook for causing said lever to pivot in the opening direction of the contacts, a manual control member connected to the contact carrying lever through a drive element, a single spring exerts on the contact carrying lever a first torque for ensuring the pressure of the contacts at least on closure and on an intermediate drive piece blockable by the hook a force transmissible to said contact carrying lever, this force being only transmitted to the lever after retractation of the hook so as to produce on the lever a second torque antagonistic to and greater than the first torque, said drive element being located so as to abut against a bearing surface provided on the lever at a position such that operation of the control member produces on the lever a third torque antagonistic to and greater than the first torque.

2. The electric switching apparatus as claimed in claim 1, wherein the angular movement of said contact carrying lever during manual opening is greater than the angular movement of said lever during tripping on a fault.

3. The electric switching apparatus as claimed in claim 1, wherein said intermediate drive piece is mounted for pivoting on a pin with axis parallel to the first axis.

4. The electric switching apparatus as claimed in claim 1, wherein said intermediate drive piece is mounted for pivoting on a pin whose axis merges with said first axis.

5. The electric switching apparatus as claimed in claim 1 wherein, between said manual control member and said contact carrying lever, a control piece is provided mounted for pivoting about a second axis parallel to said first axis, said control piece being provided with said drive element for cooperating with a shoulder of said lever, said shoulder being close to said first axis.

6. The electric switching apparatus as claimed in claim 5, wherein said manual control member is an opening and resetting button rotary about an axis perpendicular to said first and second axis and connected to a transmission piece cooperating through a cam with said control piece.

7. The electric switching apparatus as claimed in claim 5, wherein said manual control member is a rocking lever mounted for pivoting about said second axis.

8. The electric switching apparatus as claimed in claim 5, wherein said intermediate drive piece has an oblong recess for mounting with free movement on a pin having a second axis, said oblong recess having a projection against which a shoulder provided on the control piece is applied in the resetting phase.

9. The electric switching apparatus as claimed in claim 1, wherein said pivoting hook comprises an engagement element for an engagement face of said intermediate drive piece, a tripping confirmation projection cooperating with an appendix of said drive piece and a clearance for intruducing a wedge of said drive piece.

10. The electric switching apparatus as claimed in claim 1, wherein said pivoting hook comprises a catch cooperating with a stop provided on an isolating screen insertable between the fixed contact and the mobile contact.

11. The electric switching apparatus as claimed in claim 1, wherein said pivoting hook of one pole is a shaft couplable with play by means of elements of cooperating shape with the pivoting hook of an adjacent pole.

* * * * *